US005271331A

United States Patent [19]

Miller

[11] Patent Number: 5,271,331

[45] Date of Patent: Dec. 21, 1993

[54] FUZES

[75] Inventor: Andrew B. Miller, Halstead, England

[73] Assignee: The Secretary of State for Defence in Her Britannic Majesty's Government of the United Kingdom of Great Britain and Northern Ireland, London, England

[21] Appl. No.: 935,402

[22] Filed: Jul. 25, 1978

[51] Int. Cl.[5] ..... F42C 13/00

[52] U.S. Cl. ..... 102/427

[58] Field of Search ..... 102/19.2, 18 R, 18 M, 102/212, 211, 215, 417–420, 427

[56] References Cited

U.S. PATENT DOCUMENTS

| | | | |
|---|---|---|---|
| 3,094,929 | 6/1963 | McGinley et al. | 102/18 M |
| 3,125,953 | 3/1964 | Foerster | 102/19.2 |
| 3,509,791 | 5/1970 | Pechamat et al. | 102/19.2 |
| 3,763,780 | 10/1973 | Kasinoff | 102/215 |
| 4,022,128 | 5/1977 | Watson | 102/19.2 |

FOREIGN PATENT DOCUMENTS

| | | | |
|---|---|---|---|
| 2112762 | 6/1972 | France | 102/19.2 |
| 2354534 | 1/1978 | France | 102/19.2 |

*Primary Examiner*—Charles T. Jordan

*Attorney, Agent, or Firm*—Pollock, VandeSande and Priddy

[57] ABSTRACT

This invention provides a fuze which includes metering means for deriving a firing signal from the frequency-time characteristic of electrical analogue signals derived from the vibrations emanating from a moving vehicle. The firing signal may be derived by integrating or differentiating the characteristic or by measuring the instantaneous frequency of the analogue signals.

9 Claims, 1 Drawing Sheet

FUZES

Figure 1:
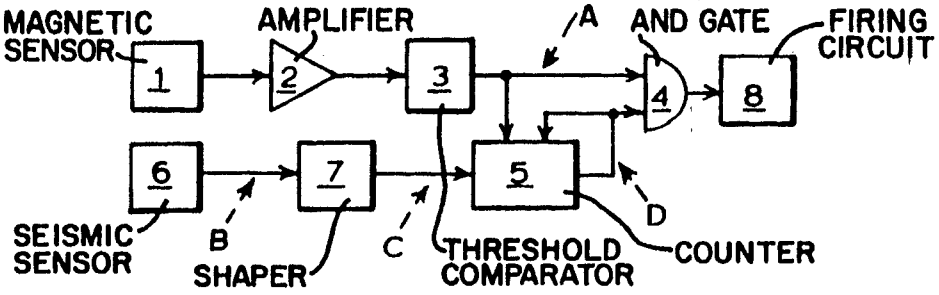

This invention relates to fuzes for explosive devices such as mines for attacking a moving vehicle such as a tank.

One known type of fuze for such explosive devices is sensitive to seismic or acoustic vibrations emanating from the moving vehicle and comprises a sensor for converting these vibrations into electrical analogue signals and metering means for deriving a firing signal from the analogue signals. The metering means integrates the amplitude-time characteristic of the analogue signals and provides the firing signal when the integral exceeds a critical value.

It is a disadvantage of this known fuze that the amplitude of the analogue signals is dependent upon the ground conditions between the sensor and the moving vehicle; consequently the firing signal may not be provided at the optimum moment.

It has been discovered by the present inventor that the mean frequency of the seismic or acoustic vibrations emanating from a moving tank varies approximately linearly with the speed of the tank. Moreover it has been discovered that the frequency distribution of the vibrations emanating from the various regions of the tank exhibits a maximum in the central region. These discoveries have been utilized in the present invention which seeks to overcome the aforesaid disadvantage by providing metering means which derives the firing signal from the frequency-time characteristic of the analogue signals.

The present invention accordingly provides a fuze for an explosive device comprising a. a sensor for converting vibrations received from the moving vehicle to electrical analogue signals,
b. metering means for deriving a firing signal from the frequency-time characteristic of the analogue signals, and
c. detecting means for enabling the metering means when the vehicle is within the vicinity of the sensor.

The metering means may, in use, integrate the frequency-time characteristic and provide the firing signal when the integral reaches a critical value. In a preferred embodiment of this invention the metering means includes a counter for counting the analogue signals and for generating a firing signal when the count reaches a critical value.

Alternatively the metering means may include a rate meter for measuring the instantaneous frequency of the analogue signals and for providing the firing signal when the instantaneous frequency passes through a maximum value.

The metering means may, in use, differentiate the frequency-time characteristic and provide the firing signal when the derivative reaches a critical value. In a preferred embodiment the metering means includes a rate meter for measuring the instantaneous frequency of the analogue signals and a differentiating circuit for differentiating the output of the rate meter and for providing the firing signal when the derivative reaches a critical value. A second differentiating circuit may be provided for differentiating the output of the first differentiating circuit to provide a second derivative for triggering the firing signal.

The sensor may be sensitive to seismic vibrations and comprises an accelerometer having a piezo-ceramic element carrying a seismic mass or the sensor may be sensitive to acoustic vibrations and comprise a microphonic element.

The detecting means may include an amplitude discriminator whereby, in use, the metering means only receives analogue signals whose amplitude exceeds a threshold value, but preferably the detecting means includes a magnetic sensor such as a magnetometer or other passive sensor arranged to provide an enabling signal to the metering means when the vehicle is within the vicinity of the sensor. Alternatively an active sensor such as one used in a metal detector may be similarly employed.

Fuzes in accordance with this invention may be provided with a waveform shaper for shaping the analogue signals into pulses before they are presented to the metering means.

Figure 2:
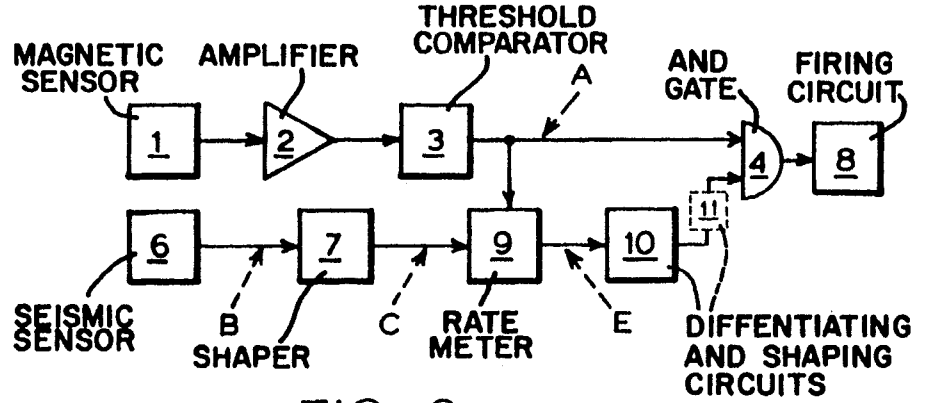
Figure 3:
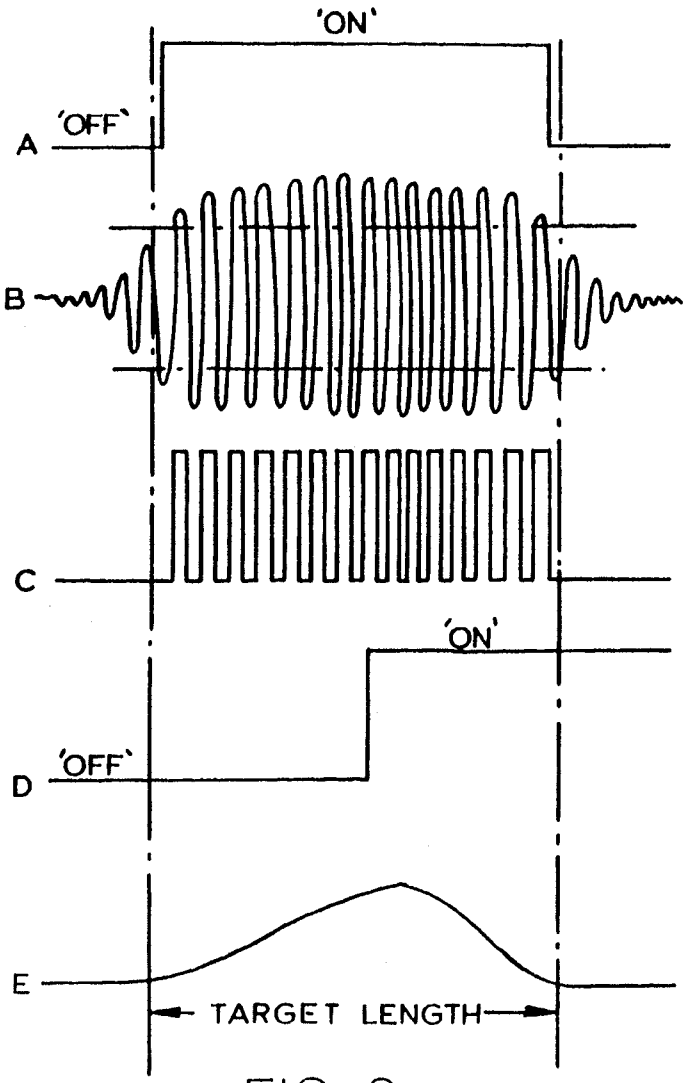

Two embodiments of the invention will now be described by way of example, with reference to the accompanying drawings of which FIG. 1 is a block schematic diagram of a first embodiment of a fuze employing metering means comprising a pulse counter, FIG. 2 is a block schematic circuit diagram of a second embodiment of a fuze employing metering means comprising a pulse rate meter, and FIG. 3 is a diagram of a waveforms occurring at the correspondingly labelled interconnections of FIGS. 1 and 2.

In the first embodiment illustrated in FIG. 1, changes in local magnetic field are sensed by detecting means comprising a magnetic sensor 1 of the magnetometer type, the output of which if fed via an amplifier 2 to a threshold comparator 3. While the level of signal fed to the threshold comparator 3 exceeds a pre-set level, an output signal, typically of a form illustrated in FIG. 3A, passes to a first input of a two-input AND gate 4 and to an enabling first input of a counter 5 comprising the metering means.

Local seismic vibrations are sensed by a seismic sensor 6 of the accelerometer type, an output signal being produced which is typically of the form illustrated in FIG. 3B. This waveform is filtered and converted in waveform shaper 7 into a train of pulses of constant width and height (FIG. 3C) which pulse train is fed to a second input of the counter 5.

Once the counter 5 has been enabled by the output of the threshold comparator 3, the incoming pulses are counted and as soon as a pre-set pulse count is reached an output signal is generated. This output signal is fed back to the counter 5 to latch the output signal on and is also fed to a second input of the AND gate 4. The pre-set pulse count can be selected so that the output signal is generated after any desired fraction of the total enablement period, i.e. the total period during which the vehicle is sufficiently close be to cause the signal fed to the threshold comparator 3 to exceed the pre-set level, and may be one half for example, giving an output waveform from the counter 5 as illustrated in FIG. 3D.

The simultaneous presence of both input signals, i.e. both waveforms A and D in the "on" condition, at the AND gate 4 generates an output signal from the gate which initiates a firing circuit 8. In the event of failure to reach the pre-set pulse count before the magnetic influence ceases, the counter 5 is re-set to zero by cessation of the enabling input received from the threshold comparator 3.

It will be apparent to those skilled in the art that the AND gate 4 is not essential in the simple arrangement of the first embodiment as the output from the counter 5 could be used to initiate firing directly. However, the introduction of a two or more input AND gate provides extra assurance that both the magnetic and seismic influences must be present before firing can occur and conveniently permits the interconnection of other control signals derived from arming circuits for example.

The second embodiment illustrated in FIG. 2 is identical with the first embodiment except that the counter 5 is replaced by a rate meter 9 followed by a first differentiating and shaping circuit 10. In this arrangement the rate of arrival of pulses in the pulse train illustrated at FIG. 3C is measured by the rate meter 9 which provides an output of the form illustrated in FIG. 3E. This output is fed to the differentiating and shaping circuit 10 to provide an output signal of suitable form for switching the AND gate 4 or alternatively for direct initiation of the firing circuit. The output signal from the circuit 10 may be further converted into second derivative form in a second differentiating circuit 11 before connection to the AND gate 4, if sharper definition of the switching signal is required.

It will be apparent that various additional circuit elements such as delay circuits may be introduced into either of the two embodiments described above in order to resist specific countermeasures such as rollers or drag chains and that the seismic sensors may be replaced by acoustic sensors. It will also be apparent that the detecting means may be other than a magnetic sensor, for example the sensor of an active device such as a metal detector. Alternatively the detecting means may comprise an amplitude discriminator interposed between the output of the seismic sensor and the metering means. Further, both the described embodiments are intended for use in mines operating in a belly-attack role, but the invention can equally well be used in mines or other explosive devices operating in a flank-attack role, an infra-red or microwave sensor for example being substituted for the magnetic sensor.

What I claim is:

1. A fuze for an explosive device, comprising a sensor for converting vibrations received from a moving vehicle to electrical analogue signals, metering means for deriving a firing signal from the frequency-time characteristic of the analogue signals, and detecting means for enabling the metering means when the vehicle is within the vicinity of the sensor, said metering means including a counter for counting the analogue signals and for providing the firing signal when the count reaches a critical value.

2. A fuze according to claim 1 wherein the detecting means includes a magnetic sensor arranged to provide an enabling signal to the metering means.

3. A fuze according to claim 1 wherein the detecting means includes an active sensor for providing an enabling signal to the metering means.

4. A fuze according to claim 1 wherein the sensor comprises an accelerometer having a piezo-ceramic element carrying a seismic mass.

5. A fuze according to claim 1 wherein the sensor comprises a microphonic element.

6. A fuze for an explosive device, comprising a sensor for converting vibrations received from a moving vehicle to electrical analogue signals, metering means for deriving a firing signal from the frequency-time characteristic of the analogue signals, and detecting means for enabling the metering means when the vehicle is within the vicinity of the sensor, said metering means including a rate meter for measuring the instantaneous frequency of the analogue signals and for providing the firing signal when the instantaneous frequency passes through a maximum value.

7. A fuze according to claim 6 wherein the metering means includes a first differentiating circuit for differentiating the output of the rate meter to provide a first derivative for triggering the firing signal.

8. A fuze according to claim 7 wherein there is provided a second differentiating circuit for differentiating the output of the first differentiating circuit to provide a second derivative for triggering the firing signal.

9. A fuze according to one of claims 1 or 6 wherein there is provided a waveform shaper for shaping the analogue signals into pulses before they are presented to the metering means.

* * * * *